US010668601B2

(12) United States Patent
Nelsen et al.

(10) Patent No.: US 10,668,601 B2
(45) Date of Patent: Jun. 2, 2020

(54) HAMMER UNION WRENCH

(71) Applicant: Nelsen Technologies Inc., Serwood Park (CA)

(72) Inventors: Blair Nelsen, Sherwood Park (CA); James Chisholm, Tofield (CA); Cody Gunderson, Sherwood Park (CA); Kevin Tidball, Edmonton (CA)

(73) Assignee: Nelsen Technologies Inc., Sherwood Park (CA)

( * ) Notice: Subject to any disclaimer, the term of this patent is extended or adjusted under 35 U.S.C. 154(b) by 176 days.

(21) Appl. No.: 15/406,513

(22) Filed: Jan. 13, 2017

(65) Prior Publication Data

US 2017/0225305 A1 Aug. 10, 2017

Related U.S. Application Data

(60) Provisional application No. 62/291,997, filed on Feb. 5, 2016.

(51) Int. Cl.

| | |
|---|---|
| ***B25B 13/50*** | (2006.01) |
| ***B25B 23/12*** | (2006.01) |
| ***B25B 19/00*** | (2006.01) |

(52) U.S. Cl.

CPC ..... *B25B 13/5091* (2013.01); *B25B 19/00* (2013.01); *B25B 23/12* (2013.01)

(58) Field of Classification Search

None

See application file for complete search history.

(56) References Cited

U.S. PATENT DOCUMENTS

| | | | |
|---|---|---|---|
| 183,344 | A | 10/1876 | Taber |
| 455,606 | A | 7/1891 | Byrne |
| 579,748 | A | 3/1897 | Haley |
| 804,008 | A | 11/1905 | Hopkins |
| 1,207,046 | A | 12/1916 | Howard |
| 1,527,772 | A | 2/1925 | Baird |
| 1,608,432 | A | 11/1926 | Ryan |
| 1,627,435 | A | 5/1927 | Hooben |
| 1,709,075 | A | 4/1929 | Howard |

(Continued)

FOREIGN PATENT DOCUMENTS

| | | |
|---|---|---|
| CA | 2810357 | 9/2014 |
| CA | 2810346 | 6/2016 |

(Continued)

*Primary Examiner* — Brian D Keller

(74) *Attorney, Agent, or Firm* — Klarquist Sparkman, LLP

(57) ABSTRACT

The invention relates to a tool for applying torque to a hammer union having a hammer union wing with wing nuts. The tool comprises a wrench having an arcuate or circular shaped wrench head that can be placed around the hammer union wing, the wrench head having wing nut cavities in the inner surface for receiving the hammer union wing nuts, and sockets around the outer surface for receiving one or more lever members such as a torque bar and/or hammer lug for applying torque to rotate the wrench head. The lever member(s) may be positioned in any of the sockets in the wrench head, thereby allowing the lever member(s) to be repositioned during use with respect to the wrench head without having to remove the wrench head from the hammer union. The wrench head may be held in place on the hammer union wing using magnets.

18 Claims, 7 Drawing Sheets

(56) References Cited

U.S. PATENT DOCUMENTS

| | | | | |
|---|---|---|---|---|
| 1,763,353 | A | 6/1930 | Heller | |
| 1,945,406 | A | 1/1934 | Adams | |
| 2,360,163 | A | 10/1944 | Sadler | |
| 2,420,458 | A | 5/1947 | Barker | |
| 2,503,364 | A | 4/1950 | Viets | |
| 2,539,262 | A | 1/1951 | Moore | |
| 2,599,668 | A | 6/1952 | Taylor | |
| 2,691,912 | A | 10/1954 | Jones | |
| 2,986,054 | A | 5/1961 | Lurie | |
| 3,604,106 | A | 9/1971 | Borries | |
| 4,013,313 | A | 3/1977 | Gardels | |
| D271,275 | S | 11/1983 | Richilano | |
| 4,483,220 | A | 11/1984 | Shindelar | |
| 4,597,123 | A | 7/1986 | Cobe, Jr. | |
| 4,644,600 | A | 2/1987 | Fugate | |
| 4,713,991 | A | 12/1987 | Gaug | |
| 4,960,014 | A | 10/1990 | Kelley | |
| 5,791,704 | A | 8/1998 | Thompson et al. | |
| 6,955,105 | B2 * | 10/2005 | Chen | B25B 13/04 81/125 |
| 9,186,780 | B2 | 11/2015 | Dumaine et al. | |
| 2014/0260817 | A1 * | 9/2014 | Wilson | B25B 13/5091 81/60 |
| 2017/0167644 | A1 * | 6/2017 | Broussard, Jr. | B25B 13/50 |

FOREIGN PATENT DOCUMENTS

| | | |
|---|---|---|
| DE | 202004010688 | 9/2004 |
| WO | WO 2010083577 | 7/2010 |

* cited by examiner

HAMMER UNION WRENCH

CROSS-REFERENCE TO RELATED APPLICATION

This claims the benefit of U.S. Provisional Application No. 62/291,997 filed on Feb. 5, 2016, the entire disclosure of which is incorporated herein by reference in its entirety.

FIELD OF THE INVENTION

The invention relates to a tool, and more specifically to a wrench for applying torque to a hammer union.

BACKGROUND OF THE INVENTION

Hammer unions are well known couplings used in the oil, gas and mining industries for fastening pipe together. For example, pipe carrying high-pressure fluids such as drilling mud, fracturing fluids and oil and gas produced in drilling activities may be coupled using hammer unions. Hammer unions generally comprise an annular metal body having a thread end and a nut end with one or more lugs or wing nuts extending outwardly from the annular body which can be struck with a hammer, e.g. a sledge hammer, to rotate the hammer union in order to tighten or loosen it. Over time, repetitively striking the wing nuts on a hammer union damages the wing nuts, causing the wing nuts to wear down and become misshapen, making the wing nuts more difficult to hit with a hammer as time goes on. If the wing nuts become too damaged, the entire hammer union must be replaced. Replacing a hammer union is generally costly and time consuming, since the pipe has to be cut apart and re-welded. This is generally becoming more of a problem as more expensive pipes are increasingly being used in drilling mud systems in oil and gas wells to accommodate higher pressures.

Instead of using a hammer to apply torque to a hammer union, a wrench may be used. However wrenches may not be able to apply enough torque to a hammer union to loosen it when a hammer union is tightly secured, and/or to tighten it enough to get a tight seal. Wrenches do not generally stand up to being hit by a hammer or other blunt force if needed when the hammer union is stuck. Wrenches may also not be able to fit on a hammer union that has damaged wing nuts.

There is a need for a system for loosening and tightening hammer unions that does not damage the hammer union. There is a further need for a system that is simple and quick to use, and holds up to harsh working conditions.

SUMMARY OF THE INVENTION

In accordance with the invention, there is provided a wrench for applying torque to a hammer union wing, the wrench comprising an arcuate or circular wrench head having an outer surface, an inner opening having an inner surface, and a gap in the circumference of the wrench head; a plurality of cavities in the wrench head inner surface for receiving wing nuts of the hammer union wing; at least one lever member for removable connection to the wrench head for applying torque to the wrench head to rotate the wrench head and hammer union wing; and a plurality of sockets in the wrench head outer surface, each socket capable of receiving the at least one lever member.

The wrench may include four sockets in the wrench head outer surface that are spaced apart at 60 degrees. The wrench may include five cavities in the wrench head inner surface spaced apart at 60 degrees. The plurality of sockets may be interspersed with the plurality of cavities about the wrench head.

The wrench may also include at least one magnet for securing the wrench head to the hammer union wing. Each cavity of the plurality of cavities may include a magnet. Each cavity may have a back surface extending radially outward from the wrench head inner surface, and the magnet in each cavity may be on the back surface.

The lever member may comprise a bar and/or a hammer lug. Each lever member may be received by any of the plurality of sockets. The lever member may be secured to the wrench head using retaining pins inserted into retaining pin holes through the wrench head and through the lever member.

Each of the plurality of cavities of the wrench may have opposing inner side surfaces that angle outwardly from the wrench head inner surface towards the wrench head outer surface.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION OF THE INVENTION

Introduction

The invention relates to a tool for applying torque to a hammer union. The tool may be particularly applicable for applying torque to a hammer union used to join pipe carrying high-pressure fluids, such as drilling mud, fracturing fluids, and oil and gas produced in drilling activities. The subject technology seeks to provide a tool for loosening and tightening hammer unions in order to connect and disconnect pipe that is simple and quick to use and does not damage the hammer union, and in particular does not damage the hammer union wing. The subject technology further seeks to provide a tool that can withstand repetitive blows from a hammer or other tool without damaging the whole tool and/or a hammer union. Furthermore, the subject technology seeks to provide a tool that does not need to be removed from a hammer union and repositioned during use in order to find an optimal angle for applying torque to the hammer union.

Figure 1:
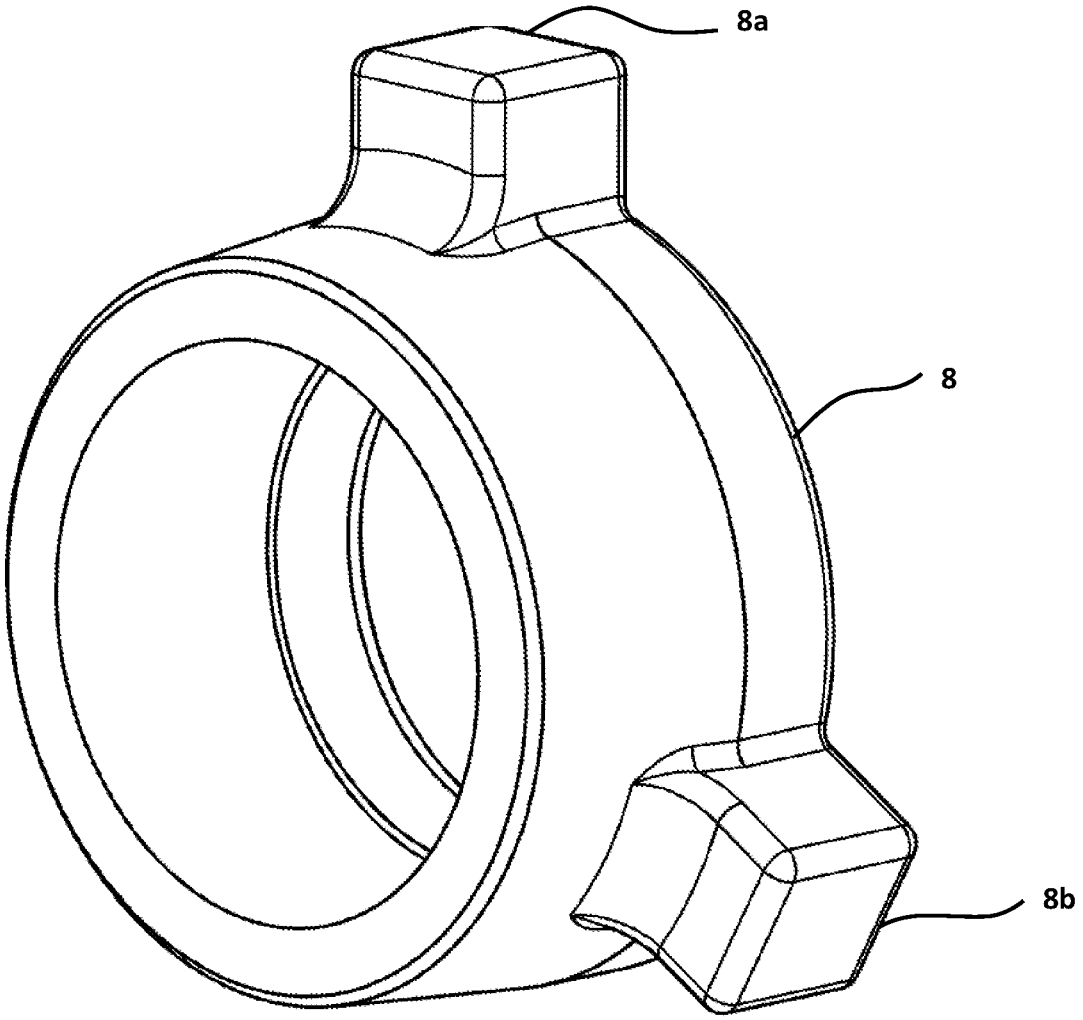
FIG. 1 (PRIOR ART)
FIG. 1 is a front perspective view of a hammer union wing as is generally known in the art.

Hammer unions are well known in the prior art, however for clarity and completeness, a typical hammer union wing 8 is illustrated in FIG. 1. The hammer union wing 8 is the portion of the hammer union that rotates in either direction about the sections of pipe in order to connect or disconnect the pipe sections, depending on the direction of rotation. The hammer union wing 8 generally comprises multiple wing nuts 8*a*, 8*b*, 8*c* that protrude from the outer surface of the hammer union wing. Typically, there are three evenly spaced nuts in the general shape of rectangular prisms that protrude radially from the hammer wing.

The tool generally comprises a wrench having a head that can be placed around the hammer union wing, the head having wing nut cavities for receiving the multiple wing nuts of the hammer union wing. The head includes multiple sockets around it's outer surface for receiving a lever member such as a torque bar and/or hammer lug, which are held in place with fasteners. The torque bar and/or hammer lugs can be used to apply torque to the wrench head in order to rotate the wrench head and thus the hammer union wing in either direction. The torque bar and/or hammer lugs can be positioned in any of the sockets in the wrench head, thereby allowing the torque bar and/or hammer lug to be repositioned during use with respect to the wrench head, without having to remove the wrench head from the hammer union. The wrench head may be held in place on the hammer union wing using magnets.

All terms used within this specification have definitions that are reasonably inferable from the drawings and description. In addition, the language used herein is to be interpreted to give as broad a meaning as is reasonable having consideration to the rationale of the subject invention as understood by one skilled in the art. It is also to be understood that prior art cited during prosecution of the subject patent application may not have been specifically identified prior to the drafting of the subject document and that various amendments may be introduced during prosecution that require amendment of terms to provide clarity to the distinctions between the subject invention and that prior art and that such amendments are reasonably inferable having consideration to the document as a whole and the rationale of the invention.

Various aspects of the invention will now be described with reference to the figures. For the purposes of illustration, components depicted in the figures are not necessarily drawn to scale. Instead, emphasis is placed on highlighting the various contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

Within this specification embodiments have been described in a way which enables a clear and concise specification to be written, but it is intended and will be appreciated that embodiments may be variously combined or separated without parting from the invention. For example, it will be appreciated that all preferred features described herein may be applicable to all aspects of the invention described herein.

The Wrench

Figure 2:
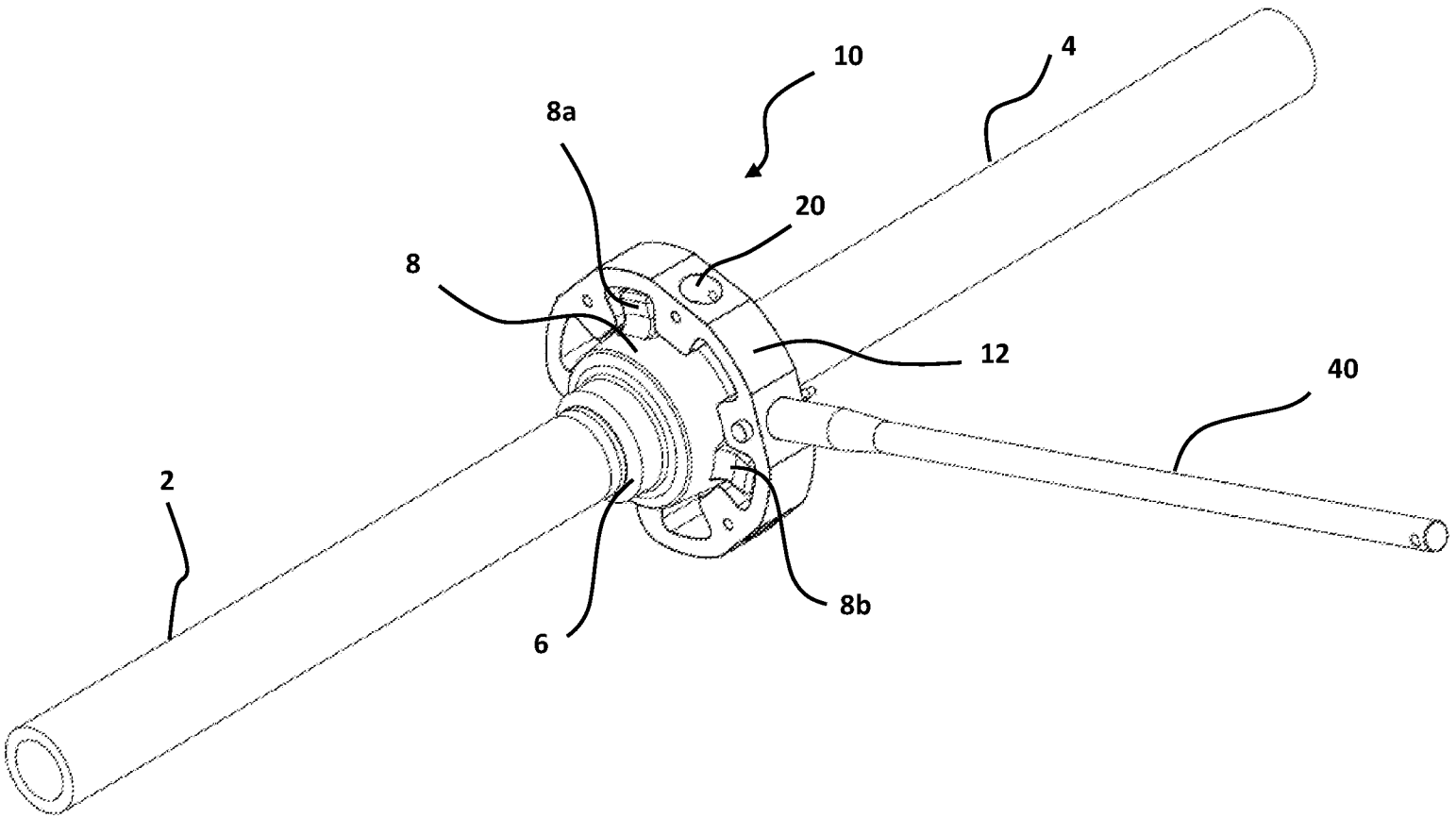
FIG. 2 is a top perspective view of a wrench on a hammer union coupling two sections of pipe together in accordance with some embodiments of the invention.

FIG. 2 illustrates the wrench 10 positioned on a pipe having a first pipe section 2 and a second pipe section 4 that are coupled together by hammer union 6. The wrench 10 generally comprises a head 12, a torque bar 40 and a hammer lug 30 (shown in FIG. 4).

Figure 3:
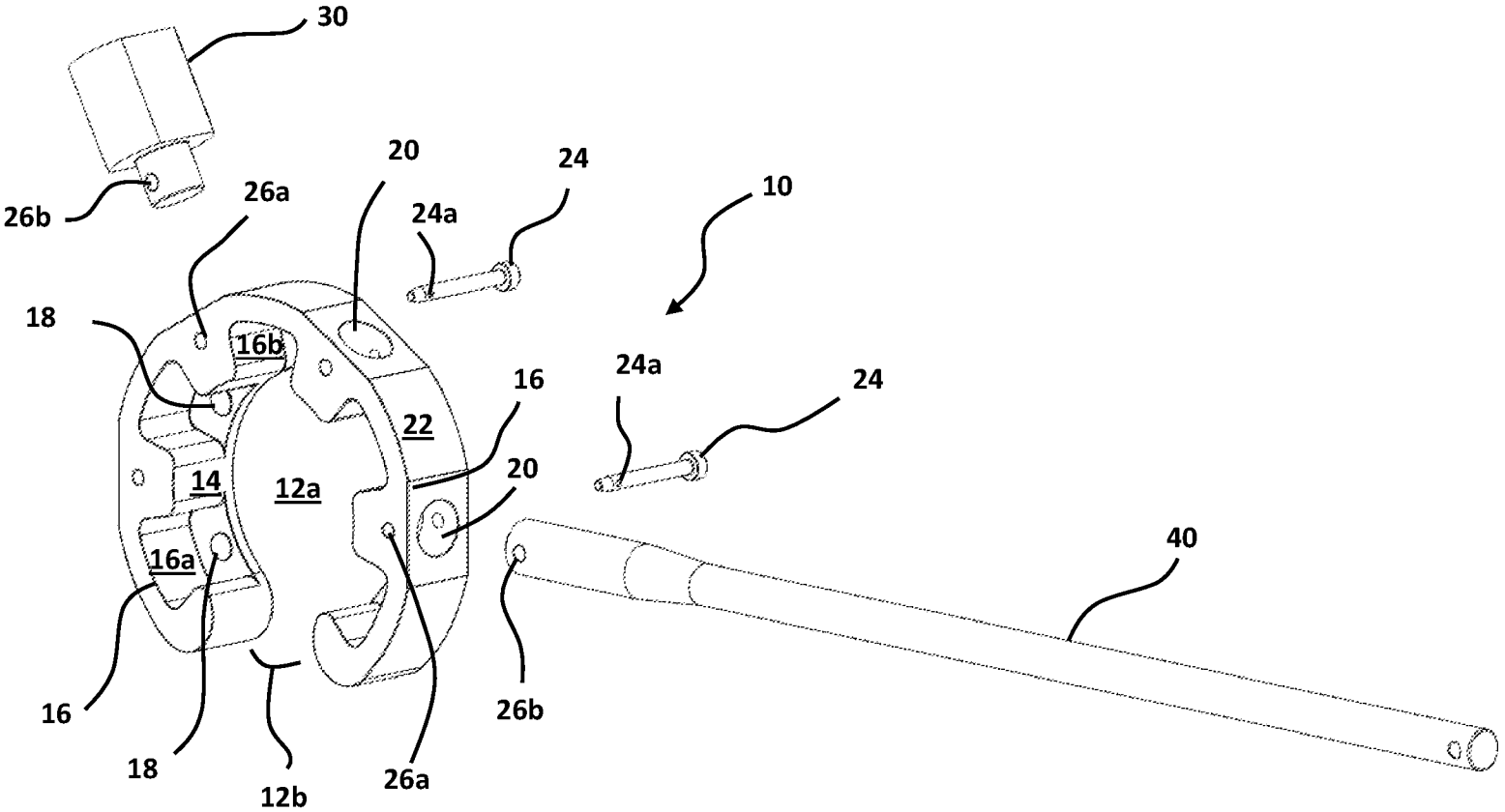
FIG. 3 is an exploded view of a wrench in accordance with some embodiments of the invention.

Referring to FIG. 3, the wrench head 12 is a generally arcuate or circular shaped head having an inner surface 14, outer surface 22, and an inner opening 12*a* sized to fit around a hammer union wing. In the circumference of the wrench head 12, there is a gap 12*b* through which a pipe can pass to enable the wrench head to be positioned around the pipe and hammer union.

The Wing Nut Cavities

In the inner surface 14 of the wrench head, there are a plurality of wing nut cavities 16 that are sized to receive the nuts 8*a*, 8*b*, 8*c* of the hammer union wing 8. Preferably, the wing nut cavities 16 are evenly spaced around the wrench head inner surface 14, sixty degrees apart as shown by $\theta_1$ in FIG. 5, the spacing of the wing nut cavities 16 matching the spacing of the nuts 8*a*, 8*b*, 8*c* on a typical hammer union wing 8 such that multiple wing nut cavities 16 can receive multiple nuts 8*a*, 8*b*, 8*c* simultaneously. Where the hammer union wing has three nuts, all three nuts may be retained within wing nut cavities 16, or two nuts may be retained in the wing nut cavities with the third nut positioned in the gap 12*b*.

Figure 7:
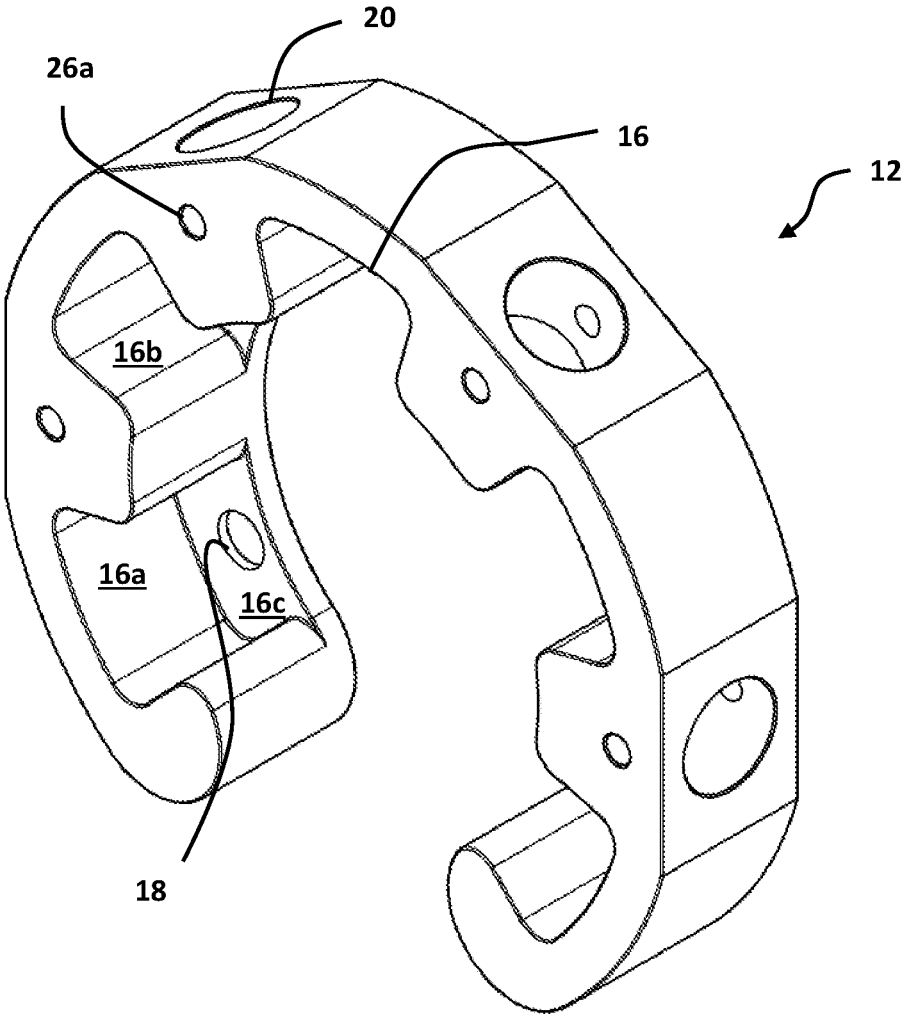
FIG. 7 is rear perspective view of the head of the wrench of FIG. 5.
Figure 8:
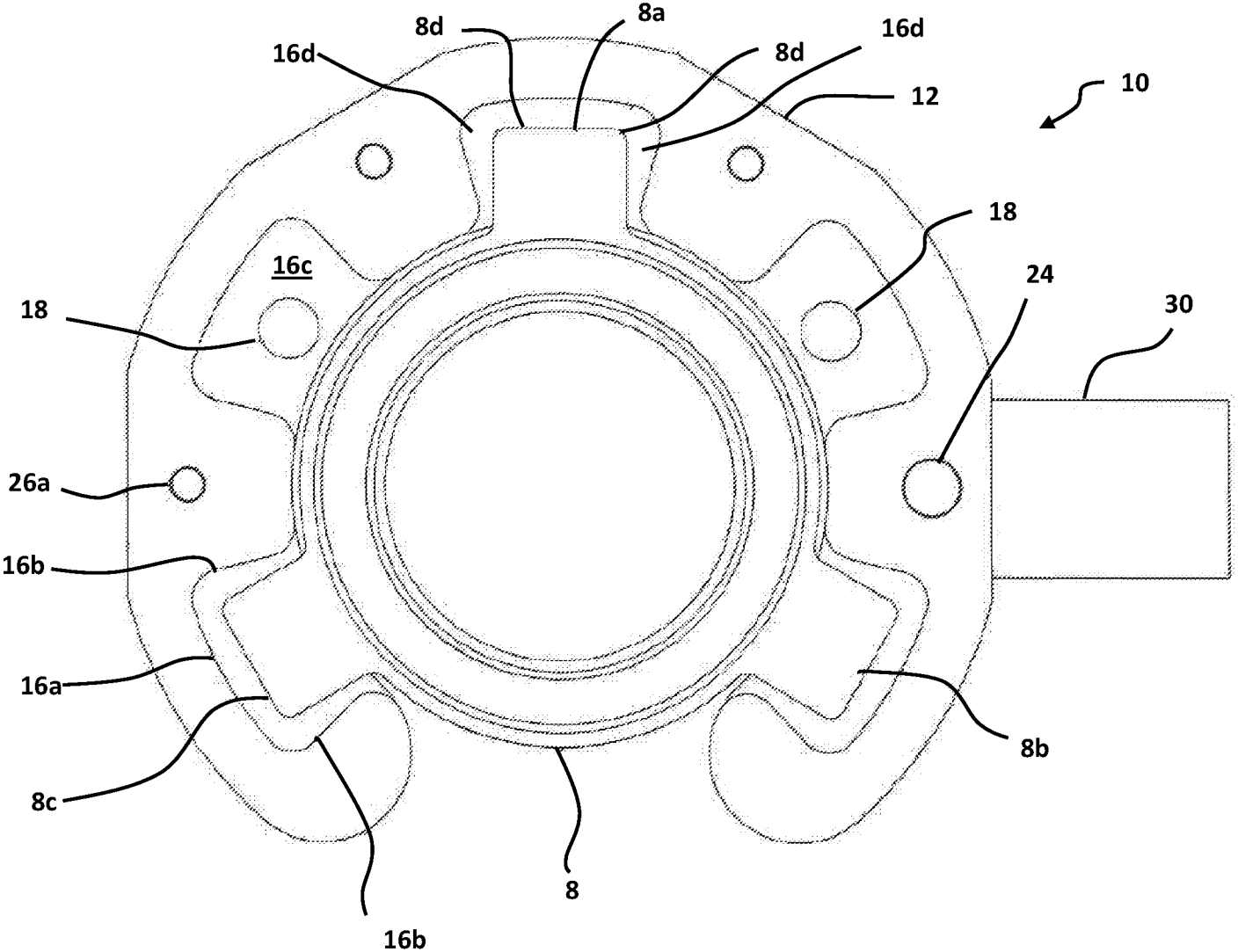
FIG. 8 is a front elevational view of a head of a wrench and hammer lug positioned on a hammer union wing in accordance with some embodiments of the invention.

As best illustrated in FIGS. 7 and 8, each wing nut cavity 16 has inner surfaces, including a top surface 16*a*, side surfaces 16*b* and a back surface 16*c*. The inner surfaces 16*a*, 16*b*, 16*c* are designed to contact the outer surfaces of a hammer union wing nut 8 during use to transfer force between the wrench and the hammer union wing. Preferably, the wing nut cavities are slightly larger than the hammer union wing nuts 8*a*, 8*b*, 8*c* to provide extra clearance to accommodate deformed wing nuts. The side surfaces 16*b* of each wing nut cavity preferably flare outwardly from the inner surface 14 of the wrench head towards the outer surface 22 of the wrench head. The flared side surfaces provide a larger gap 16*d* (shown in FIG. 8) for additional clearance between the outer corners 8*d* of the wing nuts, which are generally the parts of the wing nuts that become most deformed over time from repetitive striking with a hammer. The wing nut cavities are open on the side opposing the back surface 16*c* to allow the wrench to slip onto the hammer union wing from the side of the wing.

Each wing nut cavity 16 may include a magnet 18 for temporarily fastening the wrench head 12 to the hammer union wing 8. The magnets help keep the wrench head in the proper position on the hammer union wing by magnetically connecting each wing nut 8*a*, 8*b*, 8*c* to the inner surfaces of the wing nut cavities 16. Preferably, the magnets 18 are positioned on the back surface 16*c* of the wing nut cavities 16, as shown in the drawings. However the magnets may be positioned elsewhere on or embedded in the wrench head 12, for example on the top surface 16*a* or side surfaces 16*b* of the wing cavities 16. Alternatively, the wrench head can be fastened to the hammer union wing using other means, such as for example one or more pins, brackets or clamps.

The Wrench Head Sockets

The outer surface 22 of the wrench head 12 includes a plurality of sockets 20 for receiving a lever member, such as the hammer lug 30 or the bar 40. The sockets 20 are preferably evenly spaced around the outer surface of the wrench head, preferably 60 degrees apart as shown by $\theta_2$ in FIG. 5, and interspaced between the wing nut cavities 16 but on the opposing side of the wrench head (i.e. in the outer surface instead of the inner surface). There are at least two sockets, and preferably four sockets. The plurality of sockets 20 allow for a lever member to be fastened to the wrench head 12 at various locations around the outer surface of the wrench head. Preferably, a longitudinal axis of each socket is oriented parallel to a radial axis of the wrench head, with both the longitudinal axis and radial axis of a socket illustrated by dashed line 28 in FIG. 5.

Figure 5:
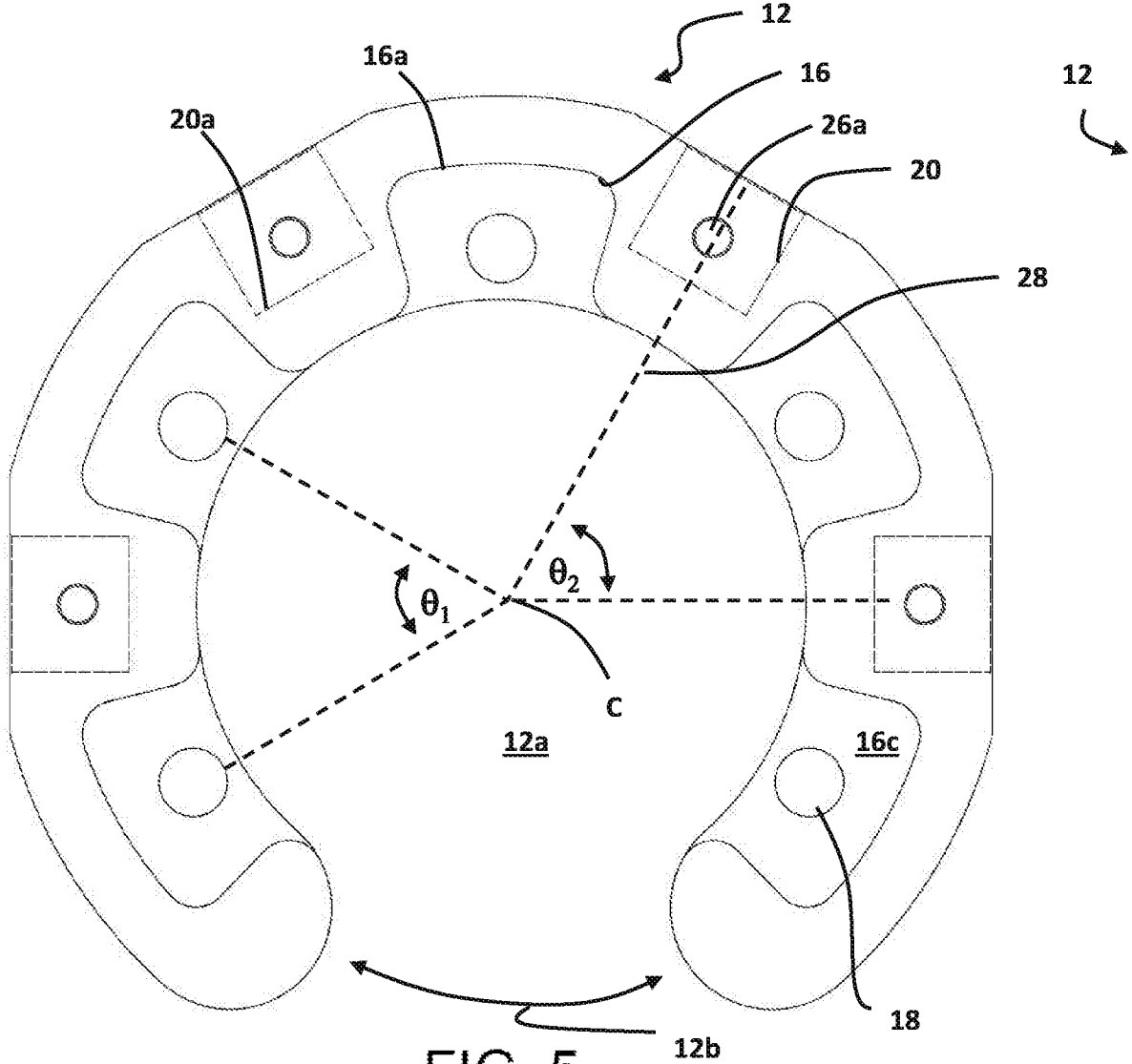
FIG. 5 is a front elevational view of a head of a wrench in accordance with some embodiments of the invention.

In one embodiment, illustrated in FIG. 5, a proximal end 20*a* of each socket 20 is located closer to the center point C of the wrench head than the distal surface 16*a* of each cavity 16.

Figure 6:
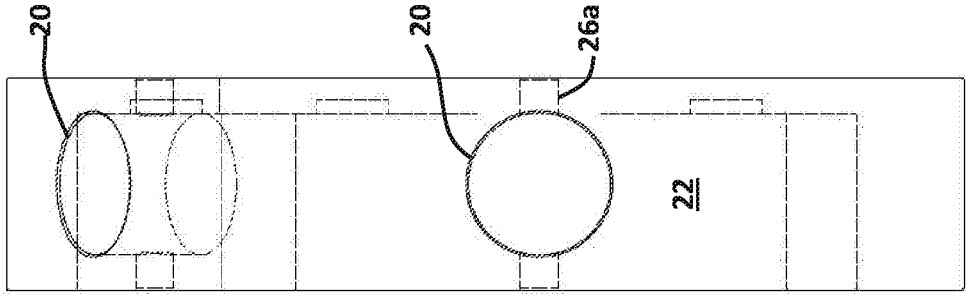
FIG. 6 is a side elevational view of the head of the wrench of FIG. 5.

The lever member is temporarily secured within the socket using a suitable fastener. The fastener may comprise a retaining pin 24 that is inserted in a retaining pin hole 26*a* that extends on either side of the socket 20 as shown in FIG. 6. Each lever member has a corresponding retaining pin hole 26*b* that lines up with the retaining pin hole 26*a* of the socket when the lever member is inserted in the socket. Each socket 20 in the wrench head includes a retaining pin hole 26*a*, and each lever member that may be inserted into the socket includes a retaining pin hold 26*b*. Optionally, a clip (not shown) may be inserted through a hole 24*a* (see FIG. 3) at a distal end of the retaining pin 24 to prevent the retaining pin from being removed from the retaining pin hole 26*a*, 26*b*. Other suitable fasteners may instead be used for securing the lever member to the wrench head, including various pins, hooks, screws, and more. The fastener may be connected to the wrench head 12 or lever member, such as by a chain or wire, to prevent dropping or losing the fastener.

Use of the Wrench

By applying force to the lever member, the wrench head can be rotated. When a lever member within a socket cannot be rotated any further due to impediments in the surrounding environment, or because the lever member is in an inconvenient position or at an angle that limits the application of force to the lever member, the lever member can be removed from the socket and inserted into another socket to position the lever member in a more convenient location to be able to apply further force to the lever member to rotate the wrench head. This allows the wrench head to be rotated 360 degrees about the hammer union in either direction regardless of where the user is positioned without having to remove the wrench head from the hammer union. When the lever member is in a position where it cannot easily be used to rotate the wrench head any further, the lever member can simply and easily be removed from the socket it is in and reinserted into the most suitable socket to continue to rotate the wrench head. For example, where the lever member is a hammer lug 30, and after striking the hammer lug, the hammer lug has rotated to an angle that makes it difficult to strike it further, the hammer lug can be repositioned in a different socket that provides a more accessible angle for striking the hammer lug. In another example, where the lever member is a bar 40, and the bar has been rotated to a point where it has hit an obstruction such as another pipe in the surrounding environment that is preventing further rotation, the bar can be removed from the socket and repositioned in another socket that allows for further rotation of the bar and wrench head to occur, all without having to remove the wrench head from the hammer union.

Figure 4:
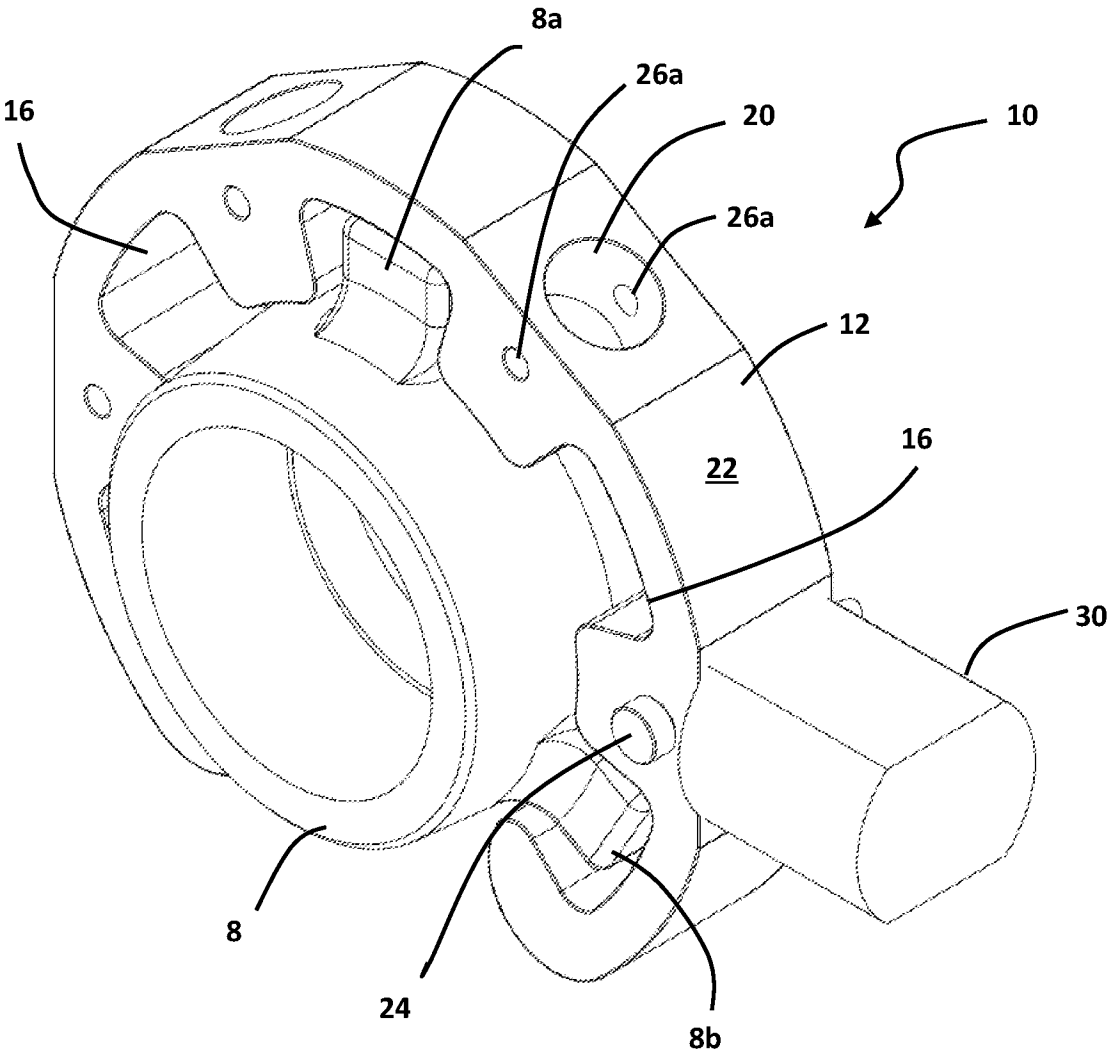
FIG. 4 is a top perspective view of a wrench with a hammer lug on a hammer union wing in accordance with some embodiments of the invention.

As previously indicated, the lever member may comprise a bar 40 and/or a hammer lug 30. FIG. 2 illustrates the bar 40 connected to the wrench head, and FIGS. 4 and 8 illustrate the hammer lug 30 connected to the wrench head. The bar 40 is preferably an elongate bar or rod to which force can be applied by hand or with a tool to create a mechanical advantage in rotating the wrench head. The hammer lug 30 is preferably a mass of metal to which force can be applied by hitting the hammer lug with a hammer, such as a sledgehammer. The hammer lug allows for a blow or sudden impact to be applied to the hammer lug to provide a large force to rotate the wrench head 12. This can be particularly useful when the hammer union wing is resisting rotation. Repetitive striking of the hammer lug may damage the hammer lug over time, decreasing the usefulness of the hammer lug. When this happens, the hammer lug can simply be replaced, without requiring the replacement of the wrench head 12 and/or the hammer union wing.

Both the bar 40 and the hammer lug 30 can be inserted into any of the sockets 20. The user may choose to use either the bar 40 or the hammer lug 30, or a combination of both the bar and the hammer lug to apply torque to the hammer union wing. For example, to loosen a hammer union wing, the user may start by inserting the hammer lug 30 into a socket and hitting the hammer lug with a sledgehammer to initiate movement of the hammer union wing. After rotation of the hammer union wing has been initiated, the user may insert the bar into a different socket from that which the hammer lug is inserted in, and apply torque to the bar by hand to rotate the hammer union wing. Alternatively, the user could remove the hammer lug and insert the bar into the same socket that the hammer lug was in. When tightening a hammer union wing, the user may choose to start with the bar 40, then use the hammer lug 30 at the end with a sledge hammer for the final tightening. A torque reading or torque setting may be incorporated into the wrench to assist a user in tightening the hammer union wing to a desired torque.

Materials and Size of the Wrench

The wrench 10, including the wrench head 12, the hammer lug 30 and the torque bar 40, is preferably made of a hard material that can withstand high forces, such as steel. The material of the wrench may vary based on the working conditions it is designed for. For example, AR400 steel may be used when increased hardness and wear resistance is required, and stainless steel may be used for corrosive environments. In some embodiments, the wrench head, hammer lug and torque bar may comprise different materials.

The wrench can be made in various sizes to accommodate various sizes of hammer unions. In some embodiments, the wrench head can be made in different sizes, whereas the lever members, including the hammer lug and torque bar, are the same size and are interchangeable between difference sizes of wrench heads. Alternatively, the lever members may vary in size.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A wrench for applying torque to a hammer union wing, the wrench comprising:

an arcuate or circular wrench head having an outer surface, an inner opening having an inner surface, and a gap in the circumference of the wrench head;

a plurality of cavities in the wrench head inner surface for receiving wing nuts of the hammer union wing;

at least one lever member configured for removable connection to the wrench head outer surface for applying torque to the wrench head to rotate the wrench head and the hammer union wing; and a plurality of sockets in the wrench head outer surface, wherein each socket is configured to receive the at least one lever member for removeable connection of the at least one lever member to the wrench head;

wherein the at least one lever member includes a substantially flat hammer striking surface, wherein the hammer striking surface can be removably connected at a plurality of locations around the wrench head outer surface through the connection of the lever member to any one of the sockets such that an end of the hammer striking surface abuts the wrench head outer surface.

2. The wrench of claim 1, wherein the plurality of sockets comprises four sockets in the wrench head outer surface that are spaced apart at 60 degrees.

3. The wrench of claim 1, wherein the plurality of cavities comprises five cavities in the wrench head inner surface spaced apart at 60 degrees.

4. The wrench of claim 1, wherein the plurality of sockets are interspersed with the plurality of cavities about the wrench head, wherein the cavities each have a distal surface and the sockets each have a proximal end, the proximal ends being closer to a center point of the wrench head inner opening than the distal surfaces of the cavities.

5. The wrench of claim 1, wherein the wrench head includes at least one magnet for securing the wrench head to the hammer union wing.

6. The wrench of claim 1, wherein each cavity of the plurality of cavities includes a magnet for securing the wrench head to the hammer union wing.

7. The wrench of claim 6, wherein each cavity of the plurality of cavities has a back surface extending radially outward from the wrench head inner surface, and the magnet in each cavity of the plurality of cavities is on the back surface.

8. The wrench of claim 1, wherein the at least one lever member is secured to the wrench head using a retaining pin inserted into a retaining pin hole through the wrench head and through the lever member.

9. The wrench of claim 1, wherein each cavity of the plurality of cavities has opposing inner side surfaces that angle outwardly from the wrench head inner surface towards the wrench head outer surface.

10. The wrench of claim 1, wherein the at least one lever member comprises two lever members comprising a torque bar and a hammer lug that each can be removably connected to any of the sockets, wherein the substantially flat hammer striking surface is on the hammer lug, and the torque bar is longer in length than the hammer lug.

11. A wrench for applying torque to a hammer union wing, the wrench comprising:

an arcuate or circular wrench head having an outer surface, an inner opening having an inner surface, and a gap in the circumference of the wrench head;

a plurality of cavities in the wrench head inner surface for receiving wing nuts of the hammer union wing, the cavities each having a distal surface;

at least one lever member configured for removable connection to the wrench head for applying torque to the wrench head to rotate the wrench head and the hammer union wing; and a plurality of sockets in the wrench head outer surface, each socket configured for receiving the at least one lever member for removeable connection of the at least one lever member to the wrench head, the sockets each having a proximal end;

wherein the sockets and the cavities are positioned around an arc of the wrench head in an alternating manner, and wherein the proximal ends of the sockets are located closer to a center point of the wrench head than the distal surfaces of the cavities.

12. The wrench of claim 11, wherein the plurality of cavities comprises five cavities in the wrench head inner surface spaced apart at 60 degrees.

13. The wrench of claim 11, wherein the plurality of sockets comprises four sockets in the wrench head outer surface that are spaced apart at 60 degrees.

14. The wrench of claim 11, wherein the at least one lever member is secured to the wrench head using a retaining pin inserted into a retaining pin hole through the wrench head and through the lever member.

15. The wrench of claim 11, wherein each cavity of the plurality of cavities has opposing inner side surfaces that angle outwardly from the wrench head inner surface towards the wrench head outer surface.

16. The wrench as in claim 11, wherein the at least one lever member includes a substantially flat hammer striking surface, wherein the hammer striking surface can be removably connected at a plurality of locations around the wrench head outer surface through the connection of the lever member to any one of the sockets.

17. The wrench as in claim 16, wherein there are two lever members comprising a torque bar and a hammer lug that each can be removably connected to any of the sockets, wherein the substantially flat hammer striking surface is on the hammer lug, and the torque bar is longer in length than the hammer lug.

18. The wrench as in claim 16, wherein when the at least one lever member comprising the substantially flat hammer striking surface is connected to any of the sockets, an end of the hammer striking surface abuts the wrench head outer surface.

* * * * *